US008529159B2

(12) United States Patent
Lemons

(10) Patent No.: US 8,529,159 B2
(45) Date of Patent: Sep. 10, 2013

(54) METHODS AND MATERIALS FOR GOLF COURSE SAND BUNKER CONSTRUCTION

(76) Inventor: Jerry Lemons, Old Hickory, TN (US)

( * ) Notice: Subject to any disclaimer, the term of this patent is extended or adjusted under 35 U.S.C. 154(b) by 743 days.

(21) Appl. No.: 12/704,802

(22) Filed: Feb. 12, 2010

(65) Prior Publication Data

US 2011/0200401 A1 Aug. 18, 2011

(51) Int. Cl.
*C09K 17/00* (2006.01)
*E02B 11/00* (2006.01)

(52) U.S. Cl.
USPC ..... 405/302.6; 405/43

(58) Field of Classification Search
USPC ..... 405/36, 43, 46, 50, 282, 302.4, 302.6; 210/170.03
See application file for complete search history.

(56) References Cited

U.S. PATENT DOCUMENTS

| | | | | |
|---|---|---|---|---|
| 4,960,345 | A * | 10/1990 | Hurley et al. | 405/38 |
| 5,752,784 | A * | 5/1998 | Motz et al. | 405/37 |
| 7,207,747 | B1 | 4/2007 | England | |
| 8,062,143 | B1 * | 11/2011 | Meersman | 473/173 |

FOREIGN PATENT DOCUMENTS

| | | | |
|---|---|---|---|
| GB | s2 035 098 | A | 8/1980 |
| JP | 2001/238337 | A | 8/2001 |

OTHER PUBLICATIONS

Artificial Turf Solutions—Shock Absorption. Datasheet[Online]. 2008 [retrieved on Mar. 31, 2011], pp. 1-2, entire document retrieved form the internet: <URL: http://www.dow.com/artificialturfsolutions/solutions/shock.htm>.

(Lemons) 'Bunker Renovations' "The Better Billy Bunker Method" Nov. 23, 2009 [retrieved on Mar. 31, 2011], pp. 1-25, entire document retrieved from the internet: <URL: http://home.comcast.net/~golflinksinc/bunkers.pdf>.

International Searching Authority—International Search Report. Apr. 11, 2011.

* cited by examiner

*Primary Examiner* — Tara M. Pinnock
(74) *Attorney, Agent, or Firm* — James M Smedley LLC; James M. Smedley, Esq.

(57) ABSTRACT

A method for building and renovating golf course sand bunkers to improve infiltration of water through a drainage system reduces the chance of contamination of the sand and to reduce erosion and maintenance and provide consistent playable sand for golf. The bunker is built to slopes based on the sand selected for use. A drainage system and a layer of fine pea gravel is installed over the entire floor of the bunker. A pre-polymer is sprayed onto the layer of pea gravel to secure it in place. The polymer sprayed bunker is permitted to cure for approximately 24 hours. A sufficient amount of bunker sand is added and compacted so the entire bunker is covered. Washed sod is placed around the bunker to stabilize the edge of the bunker.

14 Claims, 8 Drawing Sheets

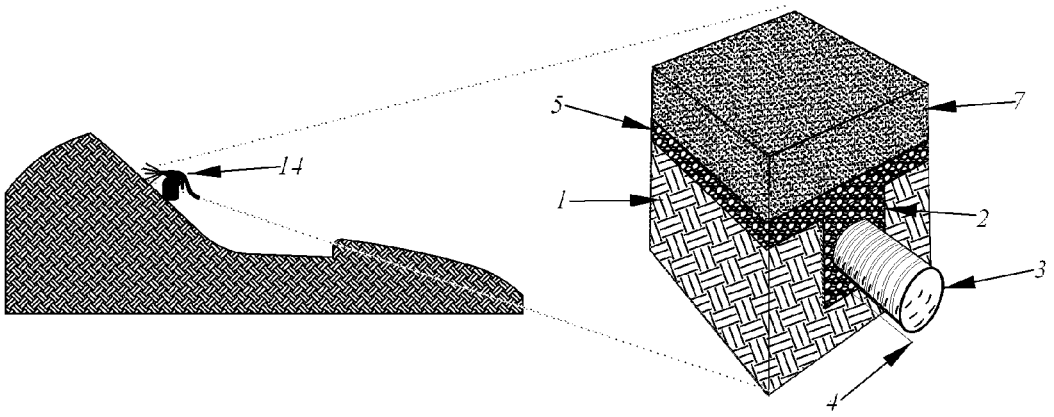
Fig. 5
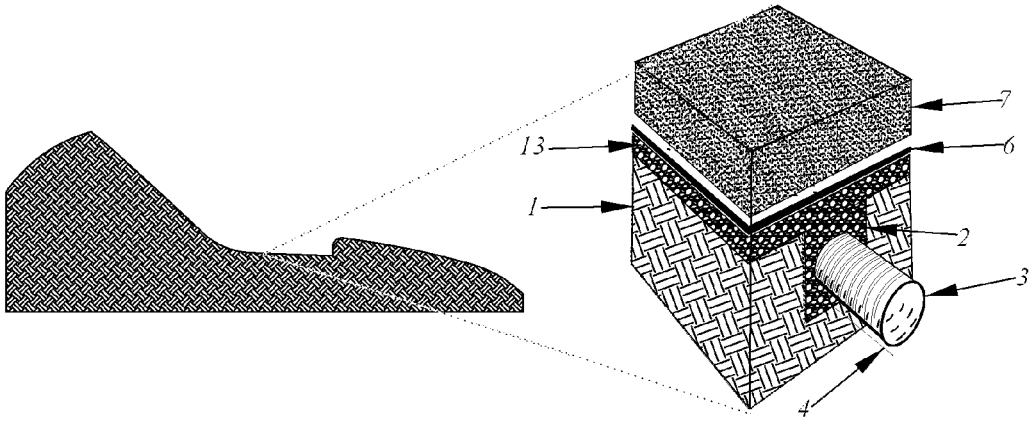
Fig. 6
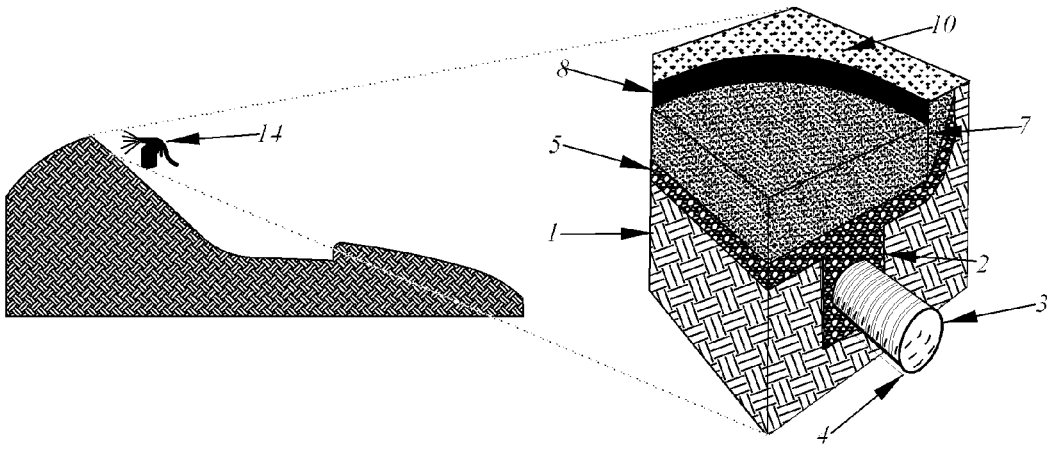
Fig. 7
Fig. 8

METHODS AND MATERIALS FOR GOLF COURSE SAND BUNKER CONSTRUCTION

FIELD OF THE INVENTION

The present invention relates generally to golf course sand bunkers. More particularly, the present invention relates to a method and materials of construction and renovation of a subsurface drainage system of a golf course to prolong the life of its bunkers and to save considerable cost to the operation of the golf course.

BACKGROUND

It is a known fact in the golf industry that the demand for high quality golf course bunkers has increased and all levels of golfers demand the same excellent bunker characteristic as found on championship golf courses. Golf courses spend an enormous amount of money and resources trying to keep sand bunkers in excellent playable conditions.

Green keepers and maintenance crews frequently spend considerable time and resources in maintaining sand bunkers and attempting to preserve the configuration and aesthetics of the bunkers, often at enormous costs. It is a matter of common experience that heavy rain erodes the sand in the bunker. The engineering phenomenon known as a radial slide is mainly the cause. A radial slide occurs in a sand bunker when the layer of sand becomes totally saturated (loaded) with water and washes down the slope of a bunker. When the eroded bunker sand washes, the native clay, silt, fine sand, and gravel that the floor of the bunker is compromised of, washes also.

This contaminates the bunker sand. The contaminated sand then becomes a mixture of the bunker sand and clays and does not drain as well as new sand due to the sands' pore spaces being filled with the finer clay. Green keepers and maintenance crews replace the contaminated sand back upon the slopes each time that a heavy rain occurs. With every rainfall, the sand becomes more contaminated. thus requiring repairs that are more frequent. After numerous washouts, the bunker sand no longer is clean and functional. Golfers complain about inconsistency and the only solution is to renovate the bunker.

One problem associated with golf course bunkers is the contamination of the sand, primarily, due to mud, clay, dirt, and gravels being mixed into the sand. This can occur from sand moving on the steep slopes from heavy rain events. The sand is contaminated from subgrade materials washing with the sand in these heavy rains, forcing green keepers to push or shovel the eroded and contaminated sand back up the slopes. This contaminated sand is then unknowingly mixed from the normal maintenance practice of using a mechanical rake after the erosion from heavy rainstorms.

After many cycles, the result is unsightly discolored sand with poor drainage. Every heavy rain events compound the problem further. In addition, this can change the consistency and playability of the sand for golfers.

Another problem associated with golf course bunkers is that due to the demand of special very white, angular, and well-drained sands by many golf courses, and the limited number of suppliers, these sands must be shipped from distances that can cause exorbitant shipping cost making the final sand cost to be very expensive.

Another problems associated with golf course bunkers is that some golf course designers insist on designing slopes of bunkers to be very steep so that the white sand can be seen from fairways or teeing ground. This is known as flashing the sand. It is known that sand cannot stay on steep slopes without constant replacement by green keepers. No method has considered what the maximum slope a particular sand should be placed.

A problem associated with golf course bunkers when using geotextile fabric liners on the floors and around the edges of bunkers to prevent erosion is that during rainstorms, the sand erodes down the slope of the bunker, thinning the layer of sand on the geotextile fabric or exposing the geotextile fabric. During routine maintenance, the geotextile fabrics are then torn and often ripped out by mechanical raking of the bunkers, causing the soil and gravel to contaminate the sand. Many golf courses have resorted to expensive hand labor to rake sand bunker that have geotextile fabric placed in them.

Another problem associated with golf course bunkers is the use of thicker matted geotextile fabric designed to allow water to move through the matt as a conduit thus preventing erosion and contamination. These matted geotextile fabric also tear by mechanical raking when sand gets thin as discussed above, but they also become flat in a short period of time and lose their ability to act as a conduit, thus they stop draining water quickly horizontally under the sand, increasing the potential for erosion of the sand to occur in heavy rainfall events. Although gravel placed beneath geotextile fabric has been used before to improve the speed of drainage, no method that locks the gravel, particles together forming a somewhat permanent and substantially porous solid mass liner has been used.

Another problem associated with golf course bunkers is erosion of native soil around the edges of the bunker from normal maintenance practices of edging or making a vertical cut in the sod of grass to make a clean edge. Greenkeepers often edge bunkers leaving exposed soil that erodes and contaminates the bunkers. Multiple techniques are currently employed in the prior art to design, construct, renovate, drain and maintain golf course sand bunkers and their edges.

Almost all techniques include the use of some type of drainage systems for the purpose of allowing water to exit from the bunker. In other techniques, liners have been used to reduce contamination of the sand and reduce erosion. However, various types of materials have been used with limited success.

SUMMARY OF THE INVENTION

Accordingly, it is an object of the present invention to design a unique construction or renovation method of sand bunkers, and to provide a construction method for improve infiltration of water through a drainage system, preventing erosion, contamination and reducing maintenance cost of golf course bunkers.

It is another object of the present invention to provide a method that utilizes the cleaver technique to use a rock layer as a conduit that when sprayed with a single component polymer forms an almost permanent drainage layer for bunkers. Therefore, substantially reduce the required maintenance due to damage from traffic, heavy rainstorms and routine maintenance and to maintain the stability and configuration of the bunkers.

it is also an object of the present invention to provide a method that employs the use of washed sod on clean sand to eliminate the potential for contamination from the normal edging that green keepers perform to maintain a vertical clean edge on sand bunkers.

In accordance with various forms of the present invention, a plurality of methods and materials are provided for treating golf course bunkers to reduce contamination of the sand and to reduce erosion and maintenance and prolong the life of the sand bunker by way of limitation to a subsurface drainage system, which promotes rapid infiltration of water and prevents contamination and erosion of sand bunkers of golf course.

In the present invention, a testing procedure of the bunker sand, while the sand is relatively dry, is provided to determine the angle of repose. Pile the sand on a level surface and measure the angle of the pile using a measuring device such as a calibrated digital level. This is the angle of repose of the tested sand. Any further testing of the sand and its characteristics should be accomplished prior to final selection.

Further, the subgrade of the bunker is then graded or shaped or reshaped in any artistic shape but the floor of the bunker's slopes where ultimately bunker sand will go must equal to or be less than 80% of the angle of repose of the tested sand. The floor should be smooth and compacted.

In addition, the floor of the bunker must have excavated drainage trenches that are wide enough so the perforated drain pipe can be installed and surrounded by gravel. The pattern is such that the perforated drain pipes do not exceed 12' from the edge of the bunker or from another perforated drain pipe. All loose soil is removed and the floor of the bunker is smooth.

A four-inch or greater perforated drain pipe with slots should be installed in the trenches and surrounded by pea gravels. Gravel should be similar to specifications used in the industry for golf putting green construction but most all pea gravels may work well. A locater wire shall then be laid and connected in the trench with the perforated drain pipe system.

A layer of pea gravels should be placed over the entire floor of the bunker 1.5"-2" deep. The gravel should be brought up to the edge of the bunker. The gravel selected is tested by an accredited soils lab for bridging with the selected sand. This common criterion is based on engineering principles that rely on the largest 15% of the sand particles "bridging" with the smallest 15% of the gravel particles. A similar layer of course crumb rubber could be used in this method as a substitute for the 1.5"-2" layer of gravel.

Thereafter, the VORAMER™ PRE-POLYMER or other similar pre-polymer is sprayed using a pressure spray gun to all areas of the bunker except portions in the lowest and flattest area. The treated bunker is allowed to cure for approximately 24 hours.

The geotextile fabric is a textile fabric with an approximate mesh opening of near to or equal to a #20 US Sieve. The fabric is placed over the area that is not treated with the VORAMER™ PRE-POLYMER or similar materials and secured in place with staples or roofing nails that will hold the geotextile fabric in place.

An adequate layer of the tested bunker sand is installed in the bunker and compacted to four to five inches deep. Care must be taken to prevent damage to the gravel layer, perforated drain pipe, and bunker edge while sand is being installed.

Finally, washed turf grass sod is placed along the edge of the bunker where the soil and new sand meet. At least one half of the width shall be placed over the new sand and cultivated for deep root growth by acceptable standards.

The likelihood of contamination of the sand by the soil and erosion of the bunker is now substantially reduced due to superior drainage and stability.

The foregoing and other objects and features of the present invention will be understood and appreciated from the ensuing detailed description of the invention and the drawings that form parts of the present application.

BRIEF DESCRIPTION OF THE DRAWINGS

Referring to the drawings, wherein like reference numerals are used to designate like parts:

FIG. 8 is a comparison schematic diagram showing the corresponding area slope of a golf course sand bunker depicted in FIG. 5, FIG. 6, and FIG. 7.

DETAILED DESCRIPTION OF PREFERRED EMBODIMENTS

Figure 1:
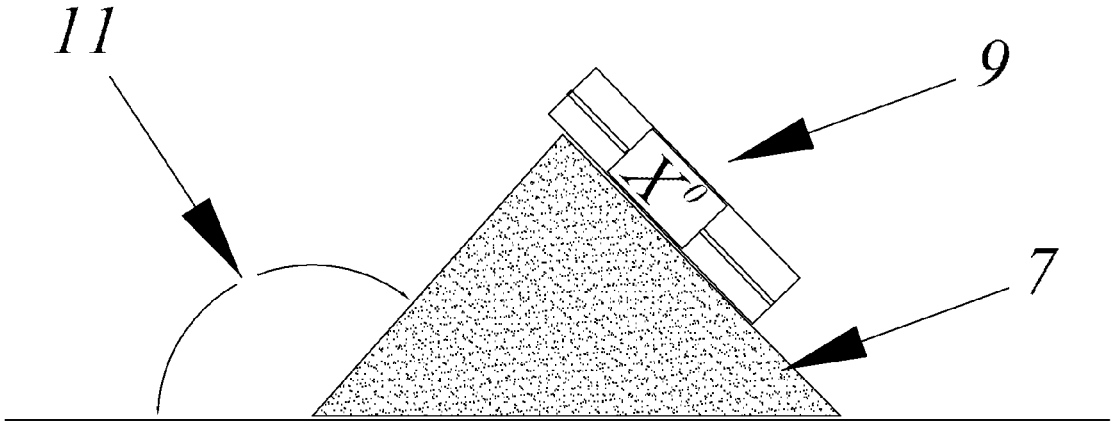
FIG. 1 is a profile side view of a preferred embodiment of the present invention showing a pile of sand defining the measurement and angle of repose of a pile of sand as indicated from a digital reading device.

Referring now to FIG. 1, the definition of the sand angle of repose is illustrated. The measurement and angle of repose 11 of a pile of sand as indicated from a digital reading device 9 is shown. The bunker sand 7 is placed over the entire bunker floor. This angle of repose is an engineering property of granular materials. It is the maximum angle of a stable slope determined by friction, cohesion and the shapes of the particles. A very easy method of measuring the angle of repose is to use a digital level 9 or a similar device to determine the angle between a level area and the angle of repose 11 of the sand 7.

In order to properly design and build a golf course bunker, it is obvious to know the proper design parameters based upon the material that are available or chosen for use. Golf course builders have always considered some physical characteristic of sand when selection including the percolation rates, particle size, color, sand particle shape, playability and numerous other characteristics. What has never been considered in proper design and in the selection of sand is the angle of repose.

It is also important in the design to understand the relationship with golf course bunker design and angle of repose 11 of the sand 7. When a bunker is built and the slope exceeds the angle of repose 11 of the chosen sand 7, the sand 7 will not stay on the slope. Sand will erode quickly in rain events, can blow from wind, and will slide down the slopes when golfers walk on the slopes and sand will slide down the slopes when golf course green keepers rake the bunkers either by hand or with a machine.

Figure 2:
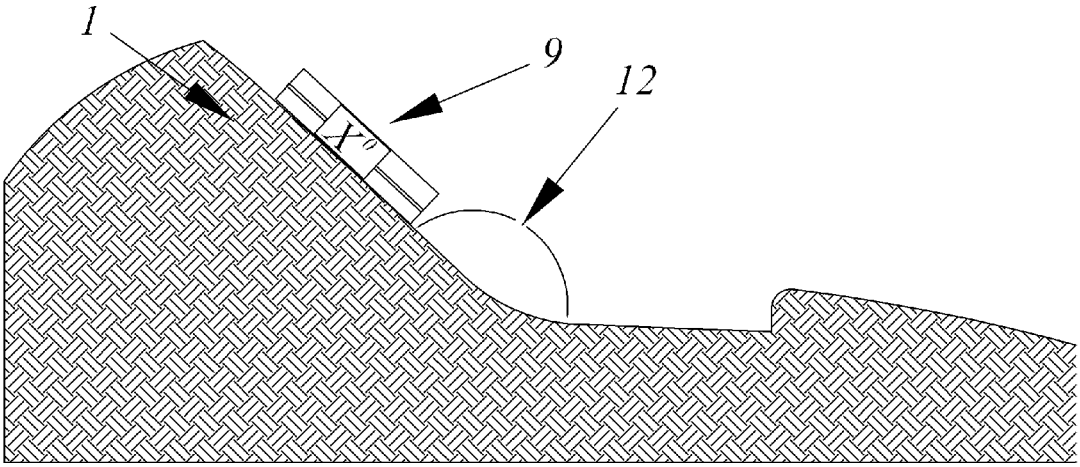
FIG. 2 is a profile side view of a preferred embodiment of the present invention showing a bunker with the sub graded area that is no steeper than 80% of the angle of repose of the sands angle in FIG. 1 as indicated from the digital reading device in FIG. 1.
Figure 3:
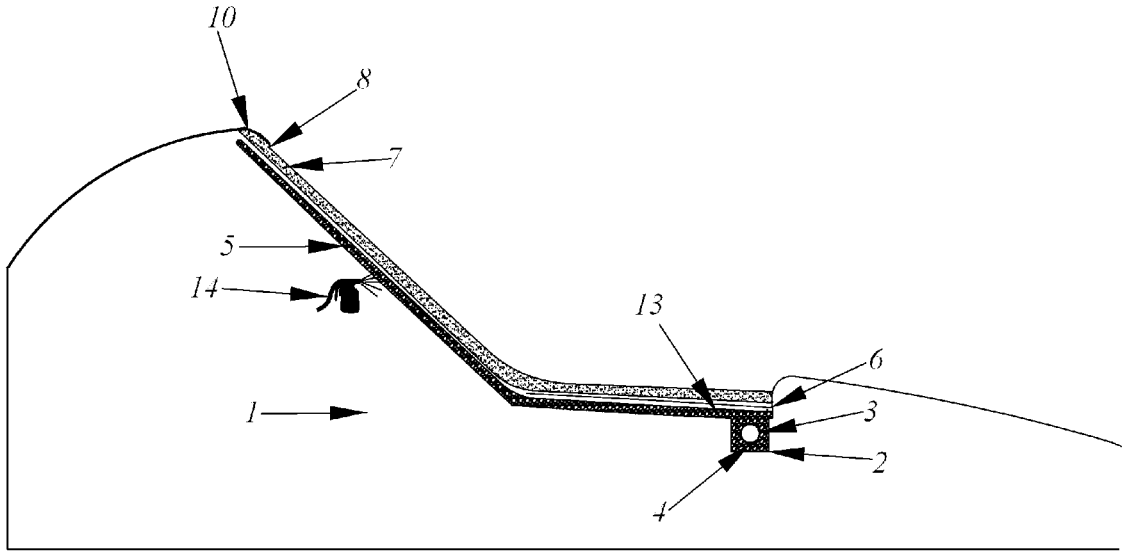
FIG. 3 is a profile side view of a preferred embodiment of the present invention showing the drainage system of a sand bunker of a golf course.

Referring to the drawings as indicated in FIG. 2, the maximum sub graded 1 that should not exceed a steeper slope than 80% of the angle of repose 11 of the sand 7 to be used. It can be measured as indicated in FIG. 1 using a digital reading device 9. The determined angle would be multiplies by 80% to determine the maximum slope to design and build in the bunker 12;

Referring now to the drawings and more particularly to FIG. 3, the sub grade 1 and the excavated drainage trenches 2 that are wide enough for a perforated drain pipe 3 to be installed and surrounded by gravel. A common four inch or greater drainage pipe with slots 3 is installed in the trenches and surrounded by pea gravel. A common insulated fourteen gauge wire 4 is used for locating the pipe in the future. The gravel 5 is sprayed with the VORAMER™ PRE-POLYMER or similar sprays. The pressure sprayer 14 is used to apply the PRE-POLYMER or other similar sprays. The untreated gravel 13 and the geotextile fabric liner 6 that is secured in place with pins or staples are layered along the slope. The bunker sand 7 is placed over the entire bunker floor after the VORAMER™ PRE-POLYMER is cured. The face or edge of the bunker 8 is where a green keeper keeps edged. The washed sod 10 is placed around the edge of the bunker.

The sub-base 1 typically includes a native sub-soil base that has been graded and packed to the proper slope to direct by gravity the movement of subsurface water. The sub-base 1 is sloped preferably to induce downhill water flow. A perforated drain pipe 3 preferably is installed at the down slope terminus of each sloped portion of the sub-base 1. The invention is not limited to such a configuration, however, and any of a wide variety of sloped sub-base arrangements may be used. The area of the sub-base 1 will generally correspond to the area of the finished bunker.

Also shown in FIG. 3 is a subsurface drainage system constructed in accordance with the present invention. The subsurface drainage system includes a drainage trench 2 which may be excavated in a plural of methods. These trenches 2 are wide enough so that a layer of gravel can be placed on the bottom of the trench and then the drainage pipe 3 added and then enough gravel or gravel around the pipe 3 then leaving enough space for a layer of gravel on top of the pipe 3 and filling the trench 2 back to the level that the sub-grade 1 was prior to excavation. This type of trench and drain is commonly called a French drain in many industries.

Also shown in FIG. 3 is a subsurface drainage system constructed in accordance with the present invention. The subsurface drainage system includes a drain pipe structure 3 typically size according to the volume of water that will flow. A corrugated plastic pipe is most common but many other pipes are sufficient as long as a multiple slots are placed in the pipe for water to enter quickly and the slots not allowing the gravel to enter.

Also shown in FIG. 3 is a subsurface drainage system constructed in accordance with the present invention. The subsurface drainage system includes a drain structure locator wire 4 that is used to locate the pipe for maintenance or mapping. This wire can be any insulated underground cable or wire that will remain intact. There are fourteen gauged underground irrigation wire commonly used but many other wires may work as well.

Also shown in FIG. 3 is a subsurface drainage system constructed in accordance with the present invention; approximately a two inch layer of gravel 5 that is spread on the bottom of the bunker. The gravel 5 is raked smoothed and allowed to air dry before being treated with a VORAMER™ PRE-POLYMER 5 or other similar sprays. The application of the VORAMER™ PRE-POLYMER is completed by using a pressure sprayer 14 and is applied to the gravel 5 and to the edges 8 around bunker causing the edges around the bunker to become porous and highly stabilized. The treated bunker is then permitted to cure for approximately 24 hours. The only area that is not treated 13 as describe is the lower area of the bunker. The area of gravel that is not treated 13 has a geotextile fabric 6 placed over the untreated gravel 13. In general, the VORAMER™ PRE-POLYMER material described above is applied by spraying onto the gravel in climatic conditions that allow the material to be sprayed uniformly.

Rates that have proven successful are 0.03-0.04 gallons of chemical per square foot but other rates may be successful as these rates are not for purposes of limiting the current invention. The preferred pre-polymer is VORAMER™ pre-polymer, which is commercially available from Dow, inc., of Atlanta Ga.

It is believed that other compositions of pre-polymers may work so long as the composition will lock the gravel particles together forming a somewhat permanent and substantially porous solid mass of a drainage liner.

It is also believed that makeup of the VORAMER™ pre-polymer can have the following ranges of materials from the specific composition described above that will perform the function: is preferred that the liquid VORAMER™ pre-polymer be a single component, wherein the Isocyanate; VORAMER MR 1180 Isocyanate is a moisture curing, solvent free, medium viscosity VORAMER™ pre-polymer based on MDI (Methylene Diphenyl Diisocyanate). It is specifically used as a moisture curing binder. VORAMER MR 1180 Isocyanate.

The liquid polymer comprises VORAMER* MR 1180 Isocyanate: MDI; VORAMER™ PRE-POLYMER Component 60.0-90.0%, Methylenediphenyl diisocyanate (MDI) 10.0-30.0% 4,4'-Methylenediphenyl diisocyanate 10.0-20.0%.

Figure 4:
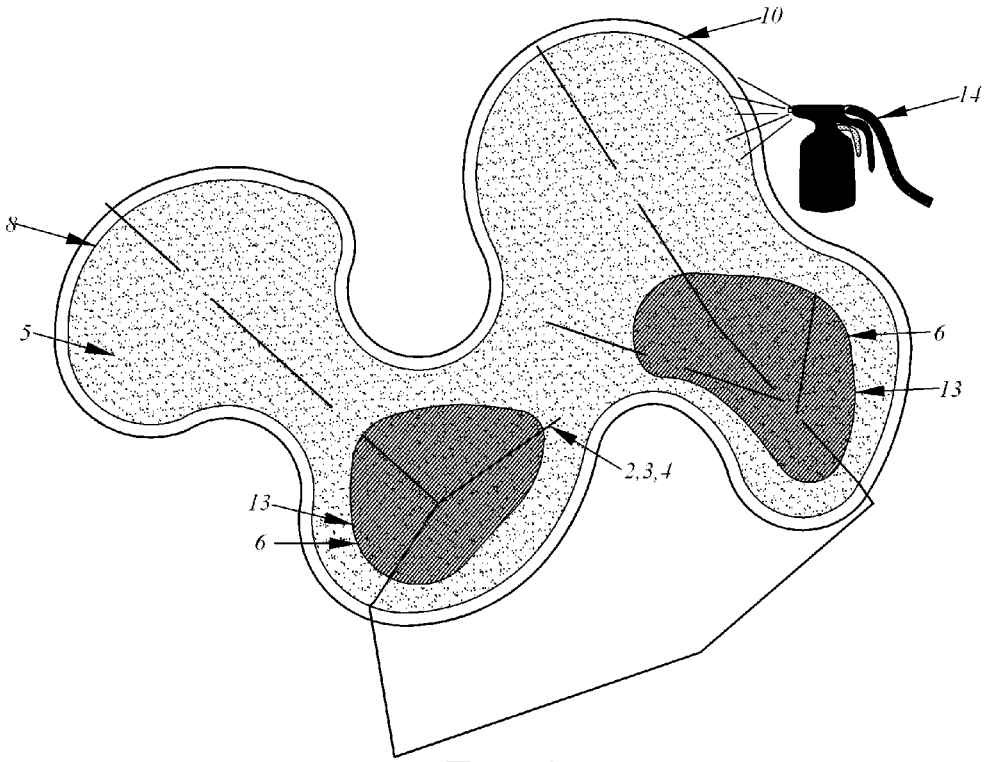
FIG. 4 is a top aerial view of a preferred embodiment of the present invention showing the drainage system of a golf course sand bunker with untreated gravel areas and geotextile fabric, and washed sod edge.

In FIG. 4, the items collectively indicated by 2, 3, 4 consist of the excavated drainage trench 2 that are wide enough for a drain pipe 3 to be installed and surrounded by gravel with a fourteen gauge wire 4 used for locating the pipe in the future. The drainage pattern layout should be such that drain lines do not exceed 12' from the edge of the bunker or another drain line. Gravel should be similar to specifications used in the industry for golf putting green construction. The material gravel 5 is treated with the VORAMER™ PRE-POLYMER, and the pressure sprayer 14 is used to apply the PRE-POLYMER. The untreated gravel area 13 is also indicated in FIG. 4. The geotextile fabric 6 with an approximate mesh opening of near to or equal to a # 20 US Sieve. It is installed over the un-treated gravel area and secured in place with staples or roofing nails that will hold the geotextile fabric in place. The edge 8 of the bunker is where a green keeper will maintain an edged. The washed sod 10 is placed around the edge of the bunker.

Also shown in the aerial view of FIG. 4 is the subsurface drainage system 2, 3, 4 collectively; drainage trench and gravel 2, pipe 3 and locator wire 4 constructed in accordance with the present invention. The area 6 includes the lowest section (approximately 5%) of the bunker, the non treated gravel 13, and the porous geotextile fabric liner 6 placed in the low flat areas and secured with pins or staples. The geotextile fabric 6 is placed only in the low flat areas of the bunker over areas that are not treated with the polymer 5. This allows the golf course green keeper, to access gravel drainage system 2, 3, 4 collectively in the lowest portion of the bunker without destroying the entire bunker. The geotextile fabric 6 has an approximate mesh opening of near to or equal to a # 20 US Sieve so that the sand will bridge and not move through the fabric into the gravel layer, but very fine soil particle may.

It is obvious to the experienced that green keepers occasionally like to flush the drain system 2, 3, 4 and add new playing sand 7 to the bunker. This system allows the green keeper to pull away the playing sand 7 in the low area, remove the small portion of geotextile fabric 6, and inspect the drainage system 2, 3, 4. A new piece of geotextile fabric 6 then may be replaced 13 and stapled or pinned into place. New sand 7 is then replaced over the geotextile fabric 6.

Also shown in the aerial view of FIG. 4 is the edge 8 of the bunker where the greens keeper maintains the vertical edge. The present invention relies up using washed sod turfgrass 10 to be placed on new sand and grown to eliminate the potential contamination of soil into the sand from edging. Once the new sand 7 is placed in the bunker and compacted, a width of washed sod 10 is placed over the new sand 7 and cultivated for good root growth. Because the grass is growing in new sand, the root system is intact and strong enough to maintain a strong and clean edge that golf course green keeper's demand.

Figure 5:
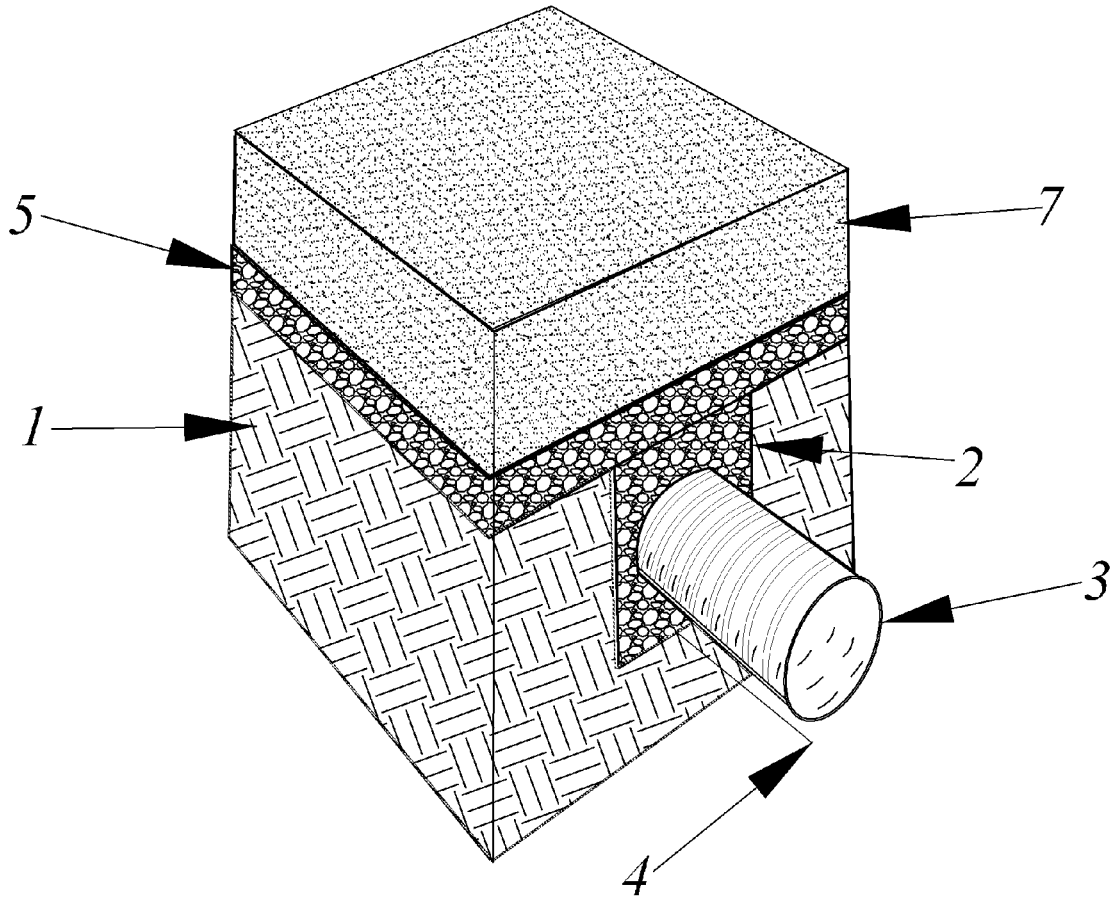
FIG. 5 is a perspective profile view of a preferred embodiment of the present invention showing a cross section of the middle to upper portion of the bunker away from the edges and lower section.

Now referring to FIG. 5, a cross section of the middle to upper portion of the bunker away from the edges and lower section is shown. The sub-grade 1 must be no steeper than 80% of the angle of repose 12 of the sand 11 in FIG. 1 as indicated from a digital reading device 9. The excavated drainage trenches 2 are wide enough for a drain pipe 3 to be installed and surrounded by gravel. A common four inch or greater drainage pipe system 3 with slots should be installed in the trenches and surrounded by pea gravel. A common insulated fourteen gauge wire 4 is used for locating the pipe in the future. The gravel 15 is treated with the VORAMER™ PRE-POLYMER using a pressure sprayer 14. The bunker sand 7 is placed over the entire bunker floor after the VORAMER™ PRE-POLYMER is cured.

Furthermore, FIG. 5 shows a perspective view of the method of construction. The compacted sub-grade 1, which slopes according to the testing previously discussed, the drainage trench 2 showing the pea gravel surrounding the slotted pipe 3, and the trench containing the locator wire 4 in the trench near the pipe are shown. The pea gravel layer 5 is spread to about a 2" depth and raked smooth then treated with the VORAMER™ pre-polymer. The VORAMER™ pre-polymer is allowed to cure for approximately 24 hours and then the geotextile fabric 6 are installed. The bunker sand 7 is then placed over the entire bunker floor and compacted using any method that will not disturb the treated gravel layer 5, untreated gravel layer 13, or drainage system 2, 3, 4, or sub-grade 1. A number of conveyor system exist that install sand with little or no damage and many methods that protect the systems are acceptable.

Figure 6:
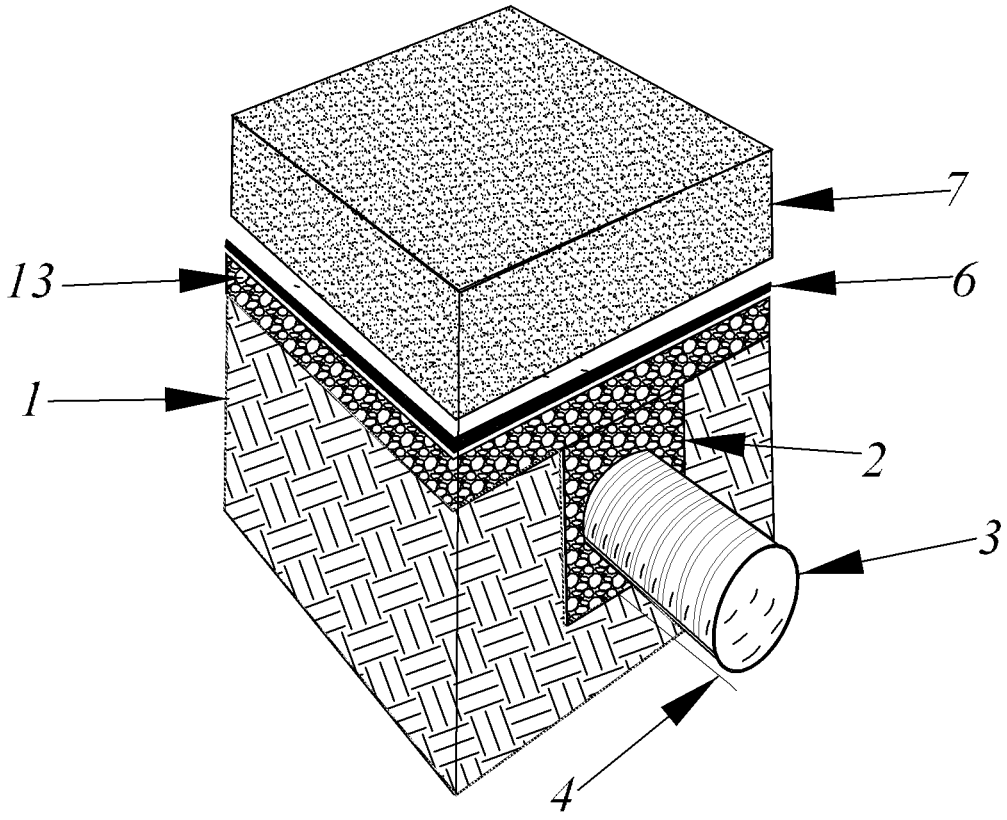
FIG. 6 is a perspective profile view of a preferred embodiment of the present invention showing a cross section of the lower portion of the bunker away from the edges.

Now referring to FIG. 6, a perspective view of the method of construction is illustrated. The sub-grade 1 must be no steeper than 80% of the angle of repose 12 of the sand 11 in FIG. 1 as indicated from a digital reading device 9. The excavated drainage trenches 2 are wide enough for a drain pipe 3 to be installed and surrounded by gravel. A common four inch or greater drainage pipe system 3 with slots should be installed in the trenches and surrounded by pea gravel. A common insulated fourteen gauge wire 4 is used for locating the pipe in the future. An untreated gravel area 13 is also illustrated. The geotextile fabric 6 with an approximate mesh opening of near to or equal to a # 20 US Sieve. It is installed over the untreated gravel area and secured in place with staples or roofing nails that will hold the geotextile fabric in place. The bunker sand 7 is place over the entire bunker floor after the VORAMER™ PRE-POLYMER is cured and the geotextile fabric has been installed.

The compacted sub-grade 1, which slopes according to the testing previously discussed, the drainage trench 2 showing the pea gravel surrounding the slotted pipe 3, and the trench containing the locator wire 4 in the trench near the pipe are disclosed. The pea gravel layer 5 is spread to about a 2" depth and raked smooth. The untreated gravel 13 is in the lowest area of the bunker.

This lower area of the bunker is not treated with the VORAMER™ pre-polymer, instead a geotextile fabric 6 is installed and secured in place by either pinning or stapling into the sub-grade 1. There are many geotextile fabrics hat will perform well with the present invention as long as they have characteristics that allow proper drainage and prevent sediment migration into the gravel 13 or drainage system 2, 3, 4. The bunker sand 7 is then placed over the entire bunker floor and compacted.

Figure 7:
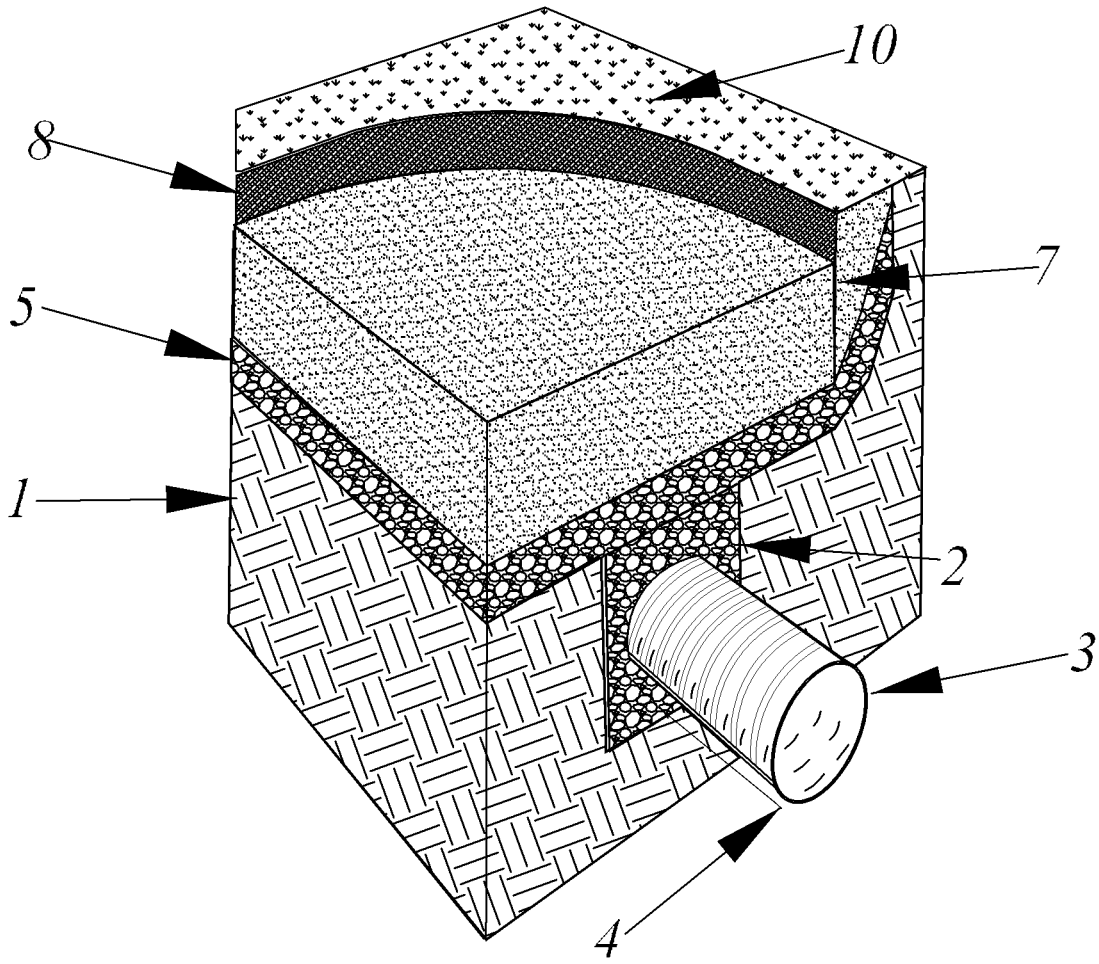
FIG. 7 is a perspective profile view of a preferred embodiment of the present invention showing a sectional view of the edge of a golf course sand bunker.

Referring to FIG. 7 now, a perspective view of the method of construction is shown in FIG. 7. The compacted sub-grade 1 which slopes according to the testing previously discussed, the drainage trench 2 showing the pea gravel surrounding the slotted pipe 3, and the trench containing the locator wire 4 in the trench near the pipe are illustrated. The pea gravel layer 5 is spread to about a 2" depth and raked smooth then treated with the VORAMER™ pre-polymer. It is well noted in this diagram that the pea gravel 5 extends upward beyond the edge 8 of the bunker. The pea gravel 5 will be spread from its thickness in the bunker behind where the final edge will be of a "0" thickness. The Pea gravel is sprayed with the VORAMER™ pre-polymer up to the top of the pea gravel where the washed sod 10 will be placed. The VORAMER™ pre-polymer is allowed to cure for approximately 24 hours and then bunker sand 7 is place over the entire bunker floor and compacted. The sand 7 is placed level with the sub-grade 1 and at least half of the width of the washed sod 8. After the washed sod 8 is in place, proper cultivation practices occur to encourage deep and fast rooting of the washed sod 8 into the sand 7. Among these cultivation practices would be watering, fertilizing, and the use of pesticides. Once the washed sod 8 has rooted, a green keeper will edge the bunker vertically at the edge 8 into the new sand but no deeper or further back than the treated pea gravel layer 5.

Using this method of testing the sand and building a golf course bunker, by applying the VORAMER™ pre-polymer in liquid form to the gravel base of a golf course bunker, which is placed over the properly graded native soil sub base that does not exceed the tested sand's angle of repose, the probability that the sand will become contaminated by the soil from the base is substantially reduced.

In addition, geotextile fabric cannot be torn around the edges in the present invention and the drainage is superior to any other method. It has been found that by applying this construction method to a golf course bunker, the probability that the sand will become contaminated or erode is substantially reduced. It is also expected to extend the life of the sand and ultimately the life of the bunker saving golf courses tens of thousands of dollars in renovation and annual maintenance.

The FIG. 8 shows the corresponding location of each of the FIGS. 5, FIG. 6, and FIG. 7. Different areas of the bunker require a different construction technique which have been illustrated and described in details in each of the embodiment description.

Although only some preferred embodiments of the invention have been described in detail above, those skilled in the art will readily appreciate that many modifications are possible in the preferred embodiments without departing from the advantages of the present invention. Accordingly, all such modifications are intended to be included within the scope of the present invention.

What is claimed is:

1. A method for constructing and renovating golf course bunkers to improve infiltration of water through a drainage system and to reduce contamination and erosion of the bunker sand comprises: testing the selected sand to be used by piling the sand on a level surface and measuring the slope angle of the sand pile; building the floor of the bunker to a grade that is less than or equal to 80% of the measured slope angle of the sand pile; installing a drainage system of perforated drain pipe with a locator wire; placing a layer of pea gravel over the entire floor of the bunker; applying a pre-polymer using a spray-gun, to 90-95% of the pea gravel at a discharge rate of 0.03-0.04 gallons per square foot; and installing a nonwoven geotextile fabric with an approximate mesh opening of #20 US Sieve, over the area that is not treated with the pre-polymer.

2. The method as claimed in claim 1, wherein the pre-polymer is applied using a spray gun, spraying all areas of the bunker except portions in the lowest and flattest area.

3. The method as claimed in claim 1 further comprises: setting the bunker to cure for approximately 24 hours; adding bunker sand to the bunker so the bunker can be compacted; and placing washed turfgrass sod along the bunker edge, whereby the likelihood of contamination of the sand by the soil and erosion of the bunker is substantially reduced.

4. The method as claimed in claim 3 further comprises: testing the bunker sand while dry to determine the maximum angle of repose, wherein the testing is done by measuring the slope angle of a pile of the bunker sand.

5. The method as claimed in claim 1 further comprises shaping or reshaping of the floor of the bunker to have the bottom of the bunker slopes equal to or less than 80% of the slope angle of the tested sand.

6. The method as claimed in claim 5 further comprises excavating drainage trenches 1.2' deep×6" wide in a pattern where the perforated drain pipe is positioned no more than ten feet from the edge of the bunker or another perforated drain pipe.

7. The method as claimed in claim 6 wherein the perforated drain pipe system comprises perforated drain pipe having a four inch diameter; and further wherein said perforated drain pipe is installed in said drainage trenches and surrounded by pea gravel.

8. The method as claimed in claim 7 further comprises installing a locater wire with the perforated drain pipe system.

9. The method as claimed in claim 8 further comprises installing a layer of pea gravel over the entire floor of the bunker 1.5"-2" deep which serves as a conduit for water to flow; and wherein a layer of coarse crumb rubber can be used as a substitute for the 1.5"-2" layer of gravel.

10. The method as claimed in claim 9 further comprises installing a nonwoven geotextile fabric with an approximate mesh opening of #20 US Sieve, over the area that is not treated with the pre-polymer.

11. The method as claimed in claim 10, wherein the pre-polymer treated bunker is permitted to cure for approximately 24 hours.

12. The method as claimed in claim 11 further comprises installing an adequate layer of the tested bunker sand in the bunker and compacting said layer of tested bunker sand to no less than four inches deep.

13. The method as claimed in claim 10 further comprises placing washed turfgrass sod on top of the edge of the bunker.

14. The method as claimed in claim 13, wherein the pre-polymer comprises VORAMER™ MR 1180 Isocyanate.

* * * * *